US006154992A

United States Patent [19]

Lee

[11] Patent Number: 6,154,992

[45] Date of Patent: Dec. 5, 2000

[54] APPARATUS FOR INTERCHANGEABLY MOUNTING PHOTOGRAPH OR OTHER DISPLAY ITEM

[76] Inventor: Razgo Lee, 1810 S. Vineyard Ave., Ontario, Calif. 91761

[21] Appl. No.: 09/234,049

[22] Filed: Jan. 19, 1999

[51] Int. Cl.[7] ..... G09F 3/08

[52] U.S. Cl. ..... 40/329; 2/209.13

[58] Field of Search ..... 2/209.13, 195.1, 2/175.4; 40/329, 586, 661.04

[56] References Cited

U.S. PATENT DOCUMENTS

| | | | |
|---|---|---|---|
| 792,533 | 6/1905 | Miller | 40/329 |
| 799,997 | 9/1905 | MacLellan | 40/329 X |
| 2,398,714 | 4/1946 | Merton | 40/329 |
| 2,577,717 | 12/1951 | Stevens | 40/329 |
| 2,803,829 | 8/1957 | Tscharner | 40/329 |
| 5,111,366 | 5/1992 | Rife et al. | 2/209.13 X |
| 5,276,985 | 1/1994 | Halloran | 40/329 |
| 5,452,479 | 9/1995 | Mostert | 40/329 X |
| 5,465,426 | 11/1995 | Beaton | 40/329 X |
| 5,548,847 | 8/1996 | Spicijaric | 40/329 X |
| 5,740,557 | 4/1998 | Reid et al. | 40/329 X |

*Primary Examiner*—Joanne Silbermann

*Attorney, Agent, or Firm*—Chan Law Group LC; Marcia Devon

[57] ABSTRACT

A photo frame apparatus capable of being mounted on a wide variety of surfaces and that provides for interchangeability of the photograph or other item being displayed. The invention comprises an outer frame, a transparent cover, a backing frame and means for attaching the outer frame to the backing frame whereby a photograph or other like item is disposed adjacent the transparent cover. The apparatus can be mounted onto a variety of surfaces to display a photograph or other like item on headwear, clothing, bags, toys or the like.

7 Claims, 3 Drawing Sheets

APPARATUS FOR INTERCHANGEABLY MOUNTING PHOTOGRAPH OR OTHER DISPLAY ITEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to photo frames, and more particularly, to an apparatus for interchangeably mounting photo frames on a wide variety of surfaces.

2. Description of the Background Art

Photo frames has long been used to display photographs, pictures, certificates or other like items. The display of photographs or the like, however, has traditionally been limited to hanging the frame on the wall or placing the frame on a table or dresser where the frame has a rear support arm to maintain the frame in a generally vertical position where the photograph may be viewed. Popular as it may be, such traditional means display photographs tend to limit the exposure the photograph gets by others due to being placed in a fixed location. If, for example, one desires to carry around a photograph, he or she generally carries it in a wallet or purse where the photo can be removed and displayed at the desired moment. Thus, the exposure of photographs in this manner is limited to situations where the user carries it with him or her wherever he or she goes and activities removes and displays the photograph when desired.

One way to provide constant display of photographs or like items is to attach the photograph to the clothing fabric where the wearer can constantly display it wherever he or she goes. In such instances, the display is generally sewn onto the clothing fabric or otherwise clipped onto some apparel. For example, name tags are traditionally displayed by clipping it onto to the pocket area of a shirt or otherwise onto the upper torso portion of the shirt. Clipping a display item onto the shirt or apparel, however, suffers the obvious risk or losing the display item whenever the wearer engages in vigorous activity or whenever the item is brushed against another object knocking it loose. Additionally, clipping the display item onto other articles such as luggage, bags, stuff animals or the like suffer from the same risks of losing the displaying item.

Another common alternative is to sew the display item onto the clothing fabric or otherwise onto the surface of the article, such as a bag, luggage or toy. Sewing the display item has a drawback as it is permanently affixed thereon, thus preventing quick and convenient interchangeability of the display when desired.

Accordingly, there exists a need for a means to attach or mount photograph or like display item onto articles such headwear, clothing, luggage, bags, toys of the like, such that the display item can be quickly and conveniently removed and replaced with either another display or on another article. The present invention satisfies these needs, as well as others, and generally overcomes the deficiencies described in the background art.

BRIEF SUMMARY OF THE INVENTION

The foregoing needs are satisfied by a photo frame apparatus in accordance with the present invention that is capable of being mounted on a wide variety of surfaces and that provides for interchangeability of the photograph or other item being displayed. The invention provides for the display of a photograph or other display item on headwear, clothing, bags, toys or the like by providing a secure attachment thereon.

In general terms, the invention comprises an outer frame, a generally transparent cover, a backing frame and means for attaching the backing frame to the outer frame. The photograph or like display item is placed on the desired location. The transparent cover is placed over the photograph and the outer frame secures the transparent cover onto the photograph. The backing plate is placed beneath the fabric material whereby the fabric material photograph and transparent cover are sandwich between the outer frame and backing frame. The outer frame is attached to the backing frame by the attachment means, which penetrates the fabric material.

An object of the invention is to provide an apparatus for attaching a photograph or like display item onto a variety of fabric surfaces.

Another object of the invention is to provide an apparatus for the attachment of the photograph or like display item on a surface while allowing the photography to be interchangeably replaced as desired.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
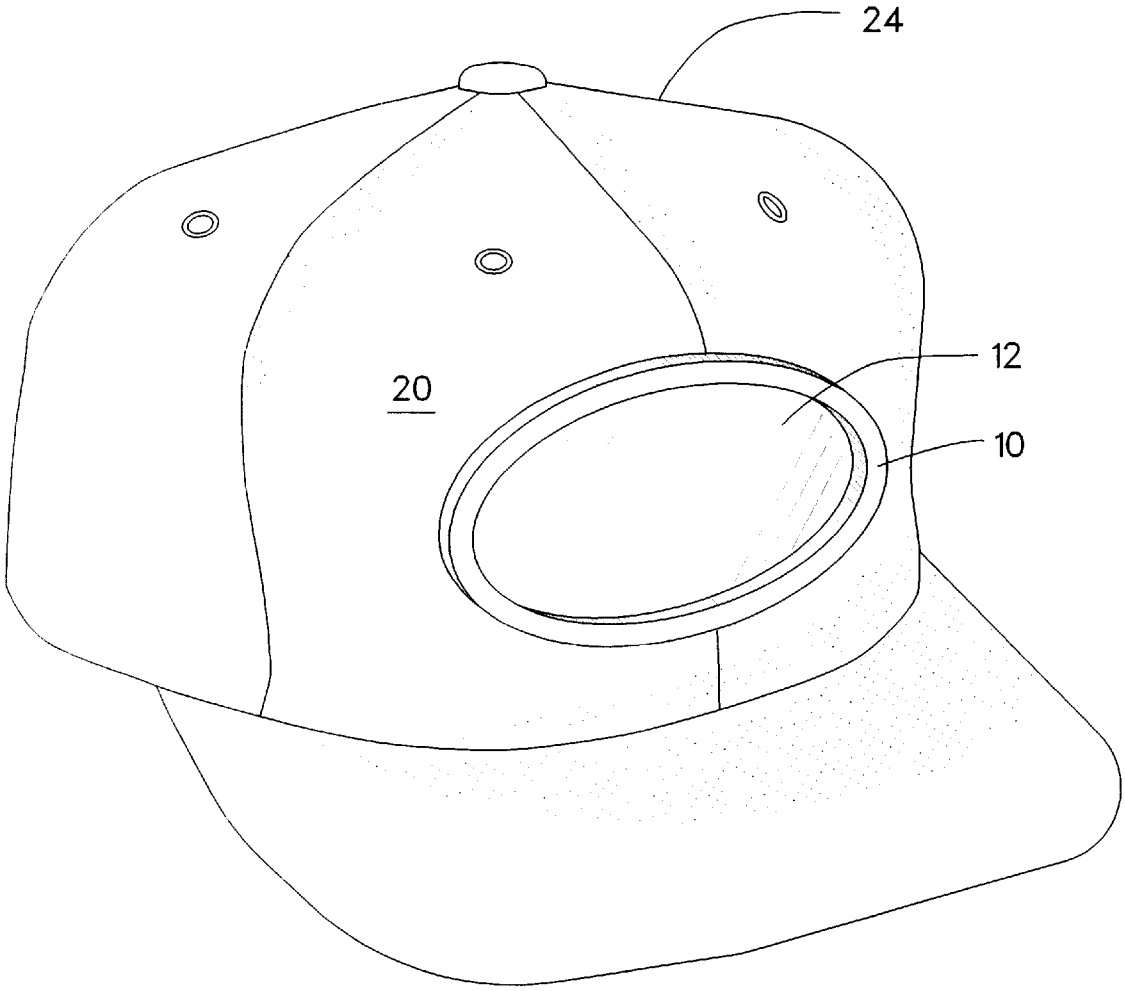
FIG. 1 is a perspective view of an apparatus for interchangeably mounting a photograph or other display item, in accordance with the present invention, shown assembled on a cap.
Figure 2:
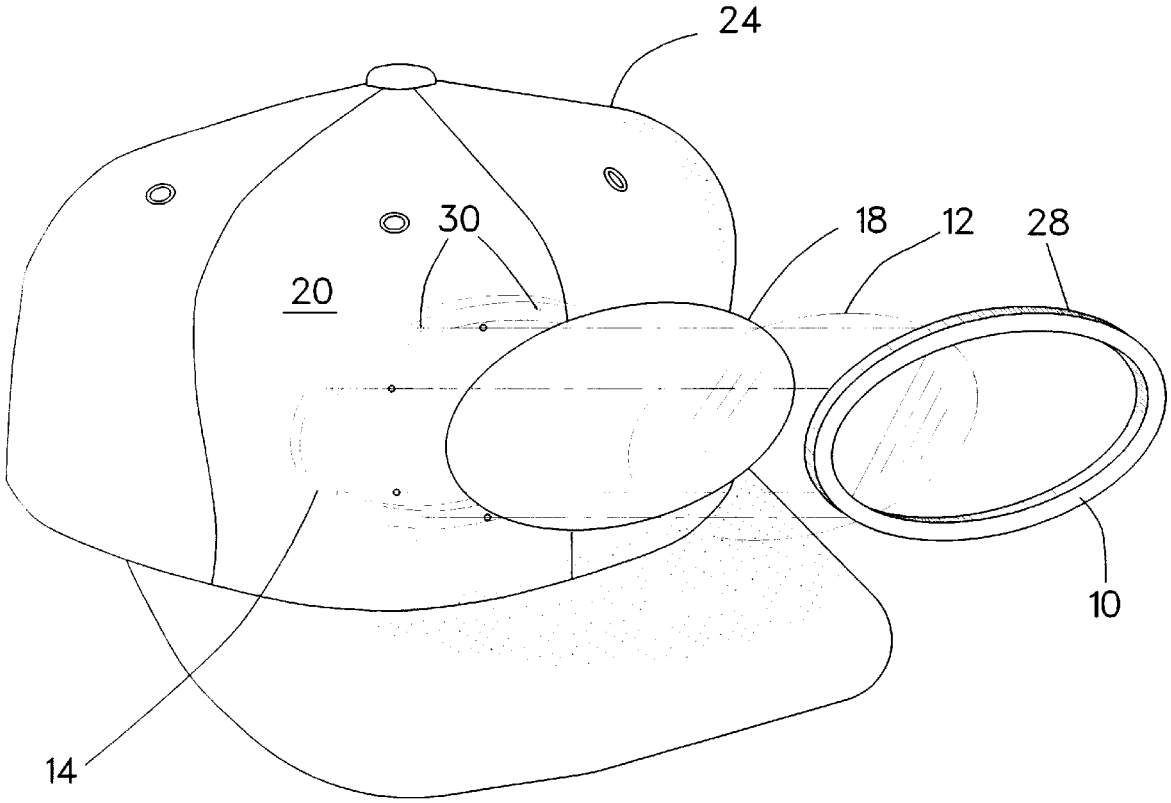
FIG. 2 is a perspective view of the invention shown in FIG. 1, with an outer frame and a transparent cover detached.
Figure 3:
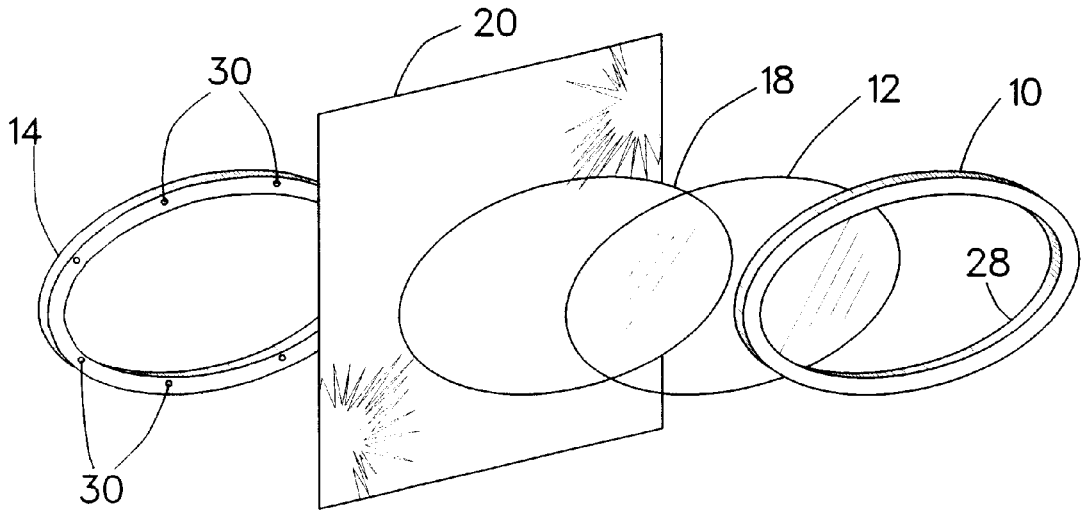
FIG. 3 is an exploded view of the invention shown in FIG. 2.
Figure 4:
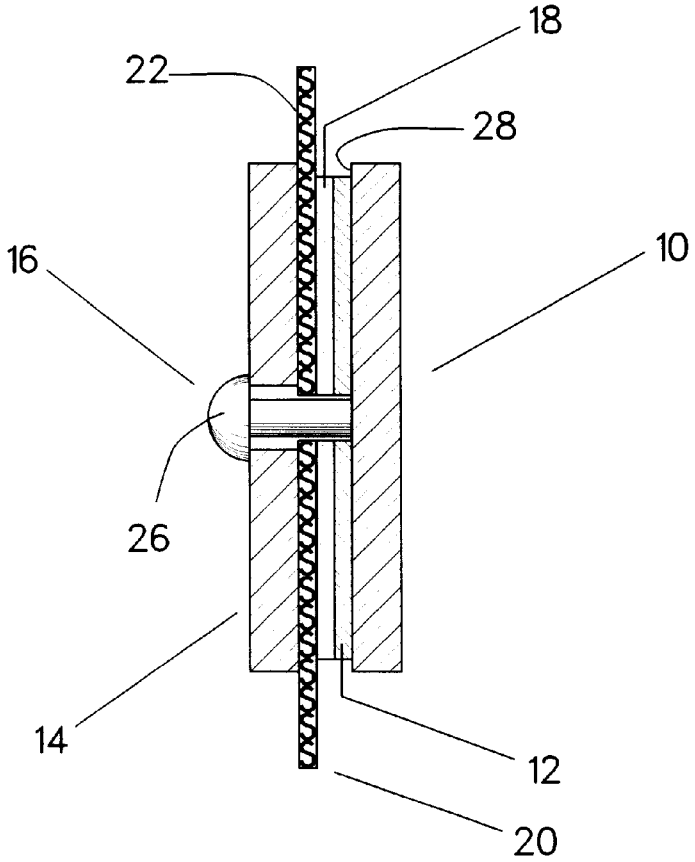
FIG. 4 is a cross-sectional view of the invention shown in FIG. 3.

Referring more specifically to the drawings, for illustrative purposes the present invention is embodied in the apparatus generally shown in FIG. 1 through FIG. 4. It will be appreciated that the apparatus may vary as to configuration and as to details of the parts without departing from the basic concepts as disclosed herein.

Referring to FIG. 1 through FIG. 4, a photo frame apparatus in accordance with the present invention is generally shown. Photo frame apparatus generally comprises an outer frame 10, a transparent cover 12, a backing frame 14, and means 16 for attaching the outer frame 10 to the backing frame 14.

A photograph or like display item 18 is placed at a desired location on a fabric surface 20. Transparent cover 12 is placed over photograph or like display item 18 to protect item 18 from moisture, tears, wrinkles or other undesirable consequences. Transparent cover 12 can not only be transparent but also translucent, as long as photograph or like display item 18 can be viewed therethrough. Outer frame 10 is secured over transparent cover 12 and onto fabric surface 20. Backing plate 14 is disposed on the underside 22 of fabric surface 20 at a location corresponding to the position of outer frame 10. Outer frame 10 is attached to backing frame 14 by attachment means 16. Attachment means 16 is removable, thereby allowing for the removal and replacement of photograph or like display item 18 as desired. Although the apparatus of the present invention is shown mounted to a cap 24, it is contemplated that the present invention can be also mounted unto a variety of articles, such as but not limited to, shirts, pants, jackets, bags, luggage and toys.

In the preferred embodiment, attachment means 16 comprises a plurality of snaps 26 extending from the inner surface 28 of outer frame 10. Snaps 26 engage holes or bores 30 disposed on backing frame 14 by passing through fabric material 20. The engagement of snaps 24 within holes or bores 30 securely mounts outer frame 10 to backing frame 14, thereby providing the compressive force necessary to hold photograph or like display item 18 in place between fabric surface 20 and transparent cover 12. Those skilled in the art will appreciated that other means for attaching outer frame 10 to backing frame 14 may be used, such as but not limited to, screws, locking tabs, buttons or the like.

Outer frame 10 can include an inner flange (not shown) disposed on inner surface 28 of outer frame 10. The inner flange is structured and configured to receive transparent cover 12 along with photograph or like display item 18 therein. This thereby allows for an additional measure of protection against loss of photograph or like display item 18 by essentially providing a receptacle wherein transparent cover 12 and photograph or like display item 18 reside.

It is contemplated that outer frame 10, transparent cover 12, and backing frame 14 are made of a plastic, or like material, to allow for flexibility, thereby allowing for movement along with fabric material 20. However, it is also contemplated that outer frame 10 and backing frame 14 can be fabricated from rigid materials such as wood, metal or the like. Moreover, it is further contemplated that the invention can be mounted onto a rigid surface, wherein openings are provided on the rigid surface for attachment means 16 to pass therethrough.

Accordingly, it will be seen that this invention provides for the interchangeable display of a photograph or other display item on headwear, clothing, bags, luggage, toys or the like by providing a quick and convenient means for mounting such display items onto a variety of fabric surfaces. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An apparatus for interchangeably mounting a display item, said apparatus comprising:

a fabric on which to mount the display item;

an outer frame mounted on the display side of the fabric;

a generally transparent cover placed between the display and said outer frame, said generally transparent cover placed over the display item and the back of the display item placed over the display side of the fabric, such that the entire surface of the back of the display item contacts the fabric to support the display item, wherein the display item is viewable through said outer frame and said transparent cover;

a backing frame placed on the underside of the fabric; and attachment means for removably attaching said outer frame to said backing frame whereby the fabric is placed between said transparent cover and said backing frame such that the display item is viewable through said outer frame and the fabric has not been altered.

2. An apparatus as recited in claim 1, wherein said removably attaching means comprises:

a plurality of snaps extending from said outer frame; and a plurality of holes disposed on said backing frame; said holes adapted to receive said snaps, thereby securing said outer frame to said backing frame.

3. An apparatus as recited in claim 1, wherein said means for attaching comprises screws.

4. An apparatus as recited in claim 1 wherein said attachment means comprises locking tabs.

5. An apparatus as recited in claim 1, wherein said attaching means comprises buttons.

6. An apparatus as recited in claim 1, wherein said outer frame, said transparent cover and said backing frame are generally flexible.

7. An apparatus as recited in claim 1, wherein said outer frame comprises an inner flange to receive said transparent cover.

* * * * *